US006189250B1

(12) United States Patent
Bell

(10) Patent No.: US 6,189,250 B1
(45) Date of Patent: Feb. 20, 2001

(54) MAGNETIC PICTURE DISPLAY DEVICE

(76) Inventor: Thomas Bell, 4539 Wawona St., Los Angeles, CA (US) 90065

( * ) Notice: Under 35 U.S.C. 154(b), the term of this patent shall be extended for 0 days.

(21) Appl. No.: 09/170,251

(22) Filed: Oct. 13, 1998

(51) Int. Cl.[7] ..... A47G 1/17

(52) U.S. Cl. ..... 40/711; 40/600; 40/124.04; 40/745; 248/467

(58) Field of Search ..... 40/711, 124.04, 40/745, 761, 600; 248/467, 206.5, 309.4

(56) References Cited

U.S. PATENT DOCUMENTS

| | | | | |
|---|---|---|---|---|
| 560,465 | * | 5/1896 | Bostwick | 40/761 X |
| 3,820,262 | * | 6/1974 | Dewsnap | 40/661 |
| 3,956,837 | * | 5/1976 | Itano | 40/745 |
| 4,475,300 | * | 10/1984 | Ledenican | 40/600 |
| 4,583,309 | * | 4/1986 | Kane et al. | 40/711 |
| 4,704,814 | * | 11/1987 | Astolfi | 40/761 |
| 5,195,263 | * | 3/1993 | Huang | 40/761 |
| 5,502,907 | * | 4/1996 | Wang | 40/711 |

* cited by examiner

*Primary Examiner*—Terry Lee Melius
*Assistant Examiner*—Rodrigo J. Morales
(74) *Attorney, Agent, or Firm*—Beehler & Pavitt; David A. Belasco; William H. Pavitt

(57) ABSTRACT

A magnetic picture display device is described. The invention includes a horizontal ground surface, a planar item to be displayed, a first support element and at least one front surface-contacting member. The display item has a front surface, a rear surface and at least one edge. The first support element has at least one ground surface contacting portion and at least one rear surface contacting portion. The rear surface-contacting portion includes ferromagnetic material. The front surface-contacting member includes a high-strength magnet. To use the invention the ground surface contacting is located on the ground surface and the rear surface of the item is located on the rear surface contacting portion of the first support element. The front surface contacting member is located on the front surface of the item at a point closest to the rear surface contacting portion of the first support element. This causes the ferromagnetic material in the front surface-contacting member to attract the ferromagnetic material in first support element and causes a magnetic field to flow through the item. The display device thus formed balances the item between its edge and the ground surface contacting portion of the first support element. Another variation of the invention includes an edge-engaging member having a first end and a second end. The first end is attached to the first support element and the second end includes a notch sized, shaped and located to engage and constrain an edge of the item to be displayed. In a further variation of the invention a second support element is provided having at least one ground surface contacting portion and at least one front surface contacting portion. The front surface-contacting portion includes a high-strength magnet. The display device balances the item to be display between its edge, the ground surface contacting portions of the first support element and the second support element.

5 Claims, 4 Drawing Sheets

Fig. 4
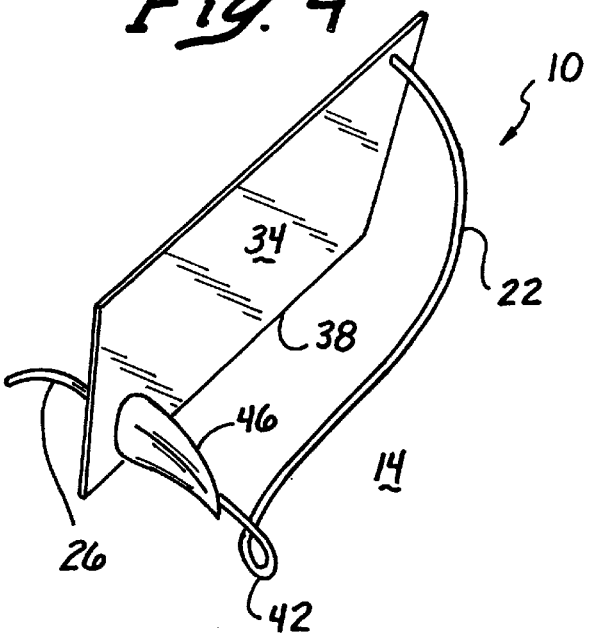
Fig. 5
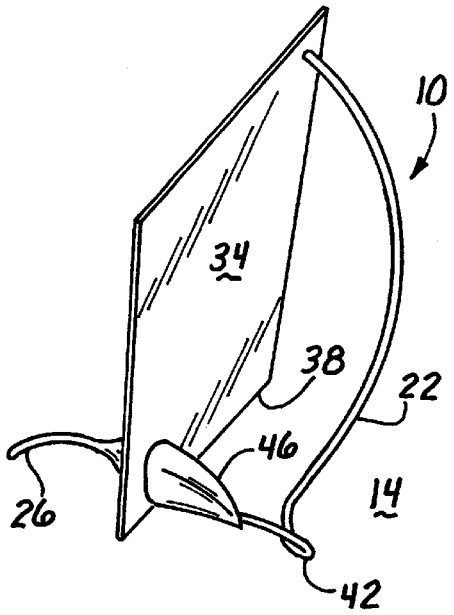
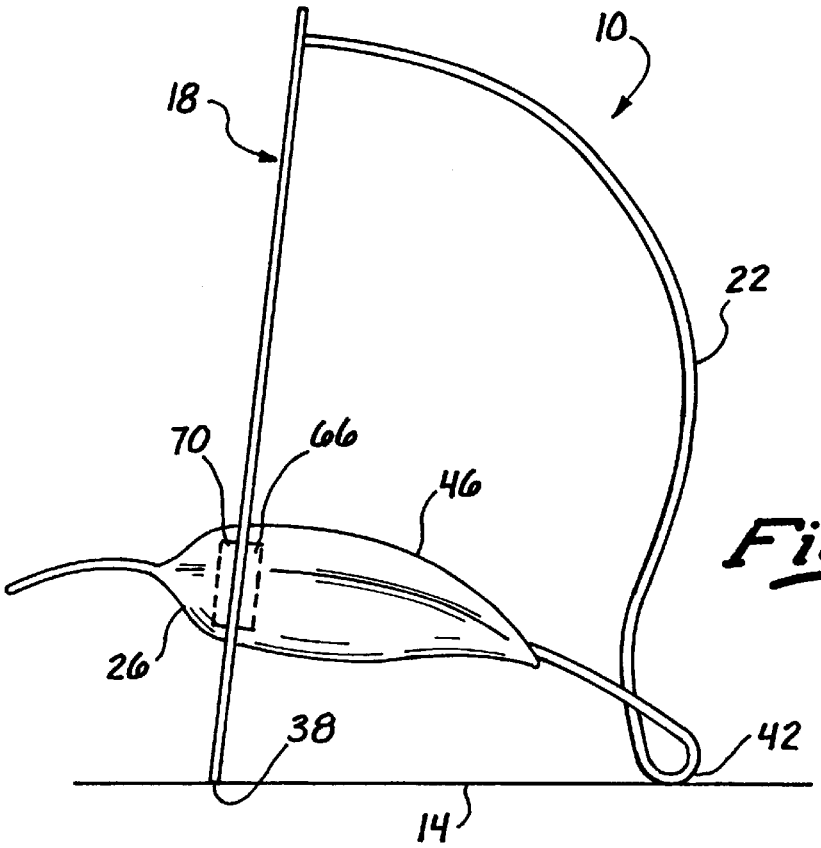
Fig. 6

MAGNETIC PICTURE DISPLAY DEVICE

FIELD OF INVENTION

The invention pertains to display and mounting devices. More particularly, the invention relates to devices for displaying cards, photographs or other thin planar object employing magnetic means to retain the object to be displayed.

BACKGROUND OF THE INVENTION

Various types of picture frames and mounting devices have been developed employing magnetic means to retain the picture or object to be displayed. U.S. Pat. No. 5,050,834 issued to Tardiff incorporates a transparent plastic plate and a plurality of holding bars with integrally molded hooks on each end engaged over the opposite side edges of the plate. Shallow offsets along the edges of the bars co-act with the back of the plate to form slots that supportingly receive the edges of cards to display them through the plate. Permanent magnets on the bars magnetically support the plate, bars and the cards from iron walls of cabinets and appliances.

In U.S. Pat. No. 3,965,599 issued to Ebner, magnets are disposed within recesses in a background member or plaque and these magnets engage metallic plates or foil elements permanently affixed to the back of a picture to be displayed for secure mounting thereof to the plaque in a predetermined orientation. U.S. Pat. No. 5,261,174, issued to Blegen employs a picture frame made from a flexible magnetic sheet material. A gift card is held to the back surface of the frame with double face tape. The frame is then attached magnetically to a metallic surface. U.S. Pat. No. 5,676,444 issued to Liao is a neon light box that has ferrometallic bars on the window and the top cover, to which a transparent cover with magnetic bars fixed thereon is attached to provide a space for displaying an advertisement slide.

While other variations exist, the above-described designs for picture frames and transparency display boxes are typical of those encountered in the prior art. It is an objective of the present invention to provide a means for displaying cards, photographs and similar items without the need for a bulky frame. It is a further objective of the invention that most, if not all of the edges of the display item be visible. It is yet a further objective of the invention that the display means be capable of orienting the display item in both a landscape and portrait orientation. It is still a further objective that the display means be simple and economical to manufacture. While some of the objectives of the present invention are disclosed in the prior art, none of the inventions found include all of the requirements identified.

SUMMARY OF THE INVENTION

The present invention addresses all of the deficiencies of prior art picture frame and related display inventions and satisfies all of the objectives described above. A magnetic picture display device providing the desired features may be constructed from the following components.

In a variation of the invention the rear surface contacting portion of the first support element includes a high-strength magnet and the front surface contacting member includes ferromagnetic material.

Another variation of the invention includes an edge-engaging member. The edge-engaging member has a first end and a second end. The first end is fixedly attached to the first support element and the second end includes a notch. The notch is sized, shaped and located to engage and constrain an edge of the item to be displayed.

To use this variation of the magnetic picture display device the first support element and front surface contacting member are removably attached to the item to be displayed and the edge-engaging member is located on the edge of the item to be displayed. This arrangement will provide additional support and rigidity to the mounting of the item to be displayed.

In a further variation of the invention a second front surface contacting member including a high-strength magnet is provided that attracts ferromagnetic material in the first support element at the rear surface contacting portion.

In a further variation of the invention a second support element is provided. The second support element has at least one ground surface contacting portion and at least one front surface contacting portion. The front surface-contacting portion includes a high-strength magnet.

To use this variation of the invention the ground surface contacting portion of the first support element is located on the ground surface and the rear surface of the planar item to be displayed is located on the rear surface contacting portion of the first support element. The ground surface contacting portion of the second support element is located on the ground surface and the front surface contacting portion of the second support element is located on the front surface of the item to be displayed at a point closest to the rear surface contacting portion of the first support element.

Thus arranged, the high-strength magnet in the second support element will attract the ferromagnetic material in the first support element and cause a magnetic field to flow through the item to be displayed. Thus a picture display device may be formed capable of supporting the item to be displayed on the horizontal ground surface. The display device balances the item to be display between its edge, the ground surface contacting portions of the first support element and the second support element.

In a final variation of the invention the rear surface contacting portion of the first support member includes a high-strength magnet and the front surface contacting portion of the second support element includes ferromagnetic material.

DESCRIPTION OF THE DRAWINGS

FIG. 4 is a perspective view of the FIG. 1 embodiment illustrating a display item held in a landscape orientation;

FIG. 5 is a perspective view of the FIG. 1 embodiment illustrating a display item held in a portrait orientation;

FIG. 6 is a side elevational view of the FIG. 1 embodiment;

DETAILED DESCRIPTION OF THE PREFERRED EMBODIMENT

Figure 1:
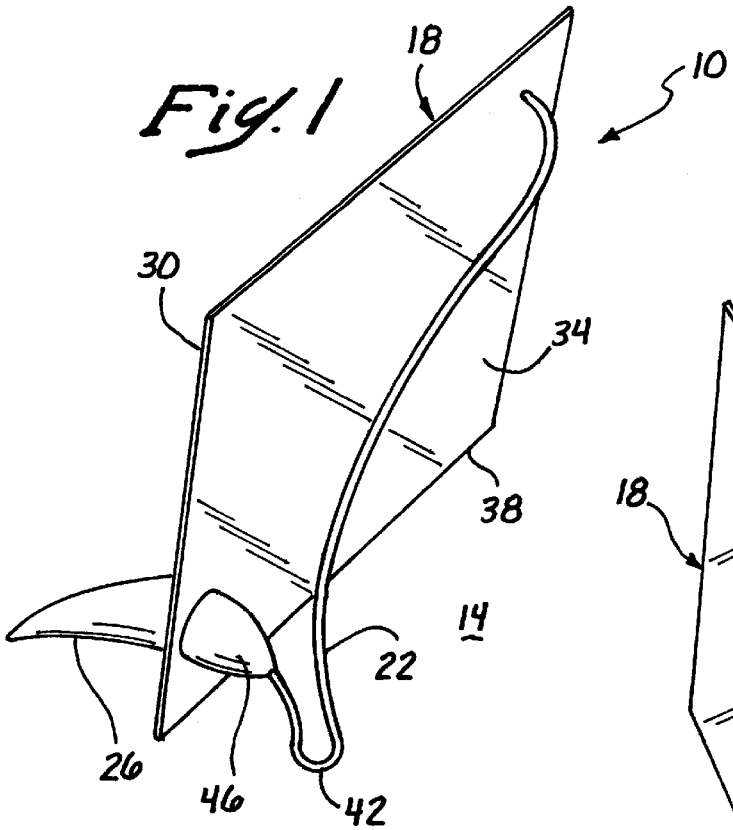
FIG. 1 is a perspective view of a first embodiment of the invention attached to a display item.

FIGS. 1 through 12 illustrate a magnetic picture display device 10 providing the desired features that may be constructed from the following components. A horizontal ground surface 14, a planar item to be displayed 18, a first support element 22 and at least one front surface contacting member 26.

Figure 2:
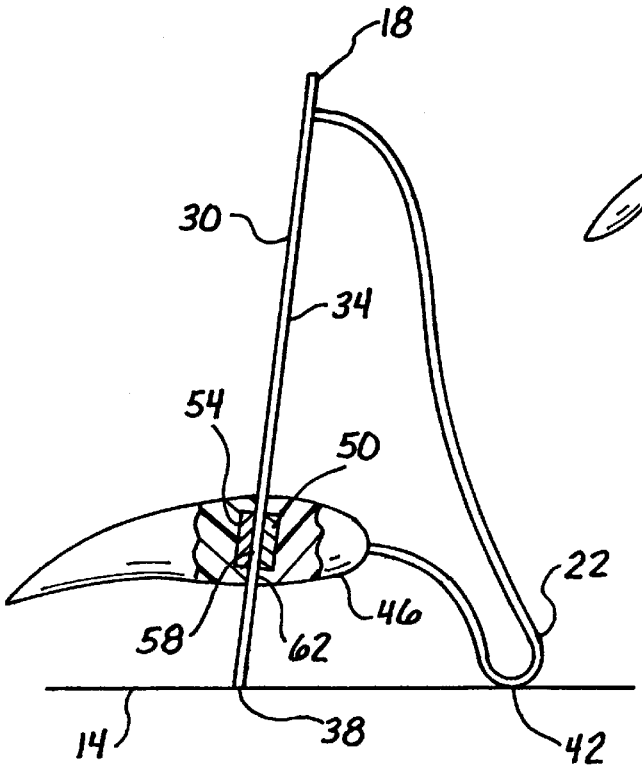
FIG. 2 is a partial cutaway side elevation of the FIG. 1 embodiment.

As illustrated in FIGS. 1 and 2, the display item 18 has a front surface 30, a rear surface 34 and at least one edge 38. The first support element 22 has at least one ground surface contacting portion 42 and at least one rear surface contacting portion 46. The rear surface-contacting portion 46 includes ferromagnetic material 50. The front surface contacting member 26 includes a high-strength magnet 54.

To use the magnetic picture display device 10 the ground surface contacting portion 42 of the first support element 22 is located on the ground surface 14 and the rear surface 34 of the planar item to be displayed 18 is located on the rear surface contacting portion 46 of the first support element 22. The front surface contacting member 26 is located on the front surface 30 of the item to be displayed 18 at a point 58 closest to the rear surface contacting portion 46 of the first support element 22. This causes the high-strength magnet 54 in the front surface contacting member 26 to attract the ferromagnetic material 50 in first support element 22 and causes a magnetic field 62 to flow through the item to be displayed 22. In this fashion a picture display device 10 may be formed capable of supporting the item to be displayed 22 on the horizontal ground surface 14. The display device 10 balances the item to be displayed between its edge 38 and the ground surface contacting portion 42 of the first support element 22.

In a variation of the invention, illustrated in FIGS. 4–6, the rear surface contacting portion 46 of the first support element 22 includes a high-strength magnet 66 and the front surface contacting member 26 includes ferromagnetic material 70.

Figure 3:
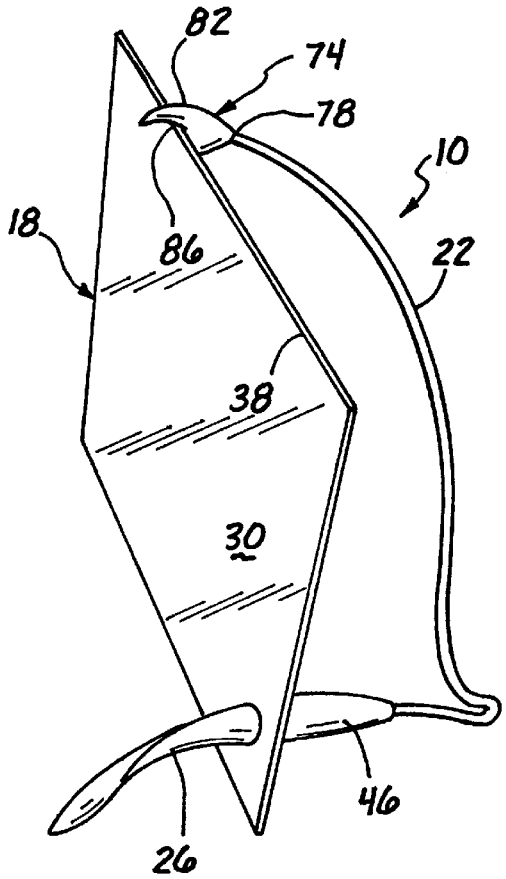
FIG. 3 is a perspective view of a second embodiment including an edge holding notch.

Another variation of the invention, illustrated in FIG. 3, includes an edge-engaging member 74. The edge-engaging member 74 has a first end 78 and a second end 82. The first end 74 is fixedly attached to the first support element 22 and the second end 82 includes a notch 86. The notch 86 is sized, shaped and located to engage and constrain an edge 38 of the item to be displayed.

To use this variation of the magnetic picture display device 10 the first support element 22 and front surface contacting member 26 are removably attached to the item to be displayed 18 and the edge-engaging member 74 is located on the edge 38 of the item to be displayed 18. This arrangement will provide additional support and rigidity to the mounting of the item to be displayed 18.

Figure 7:
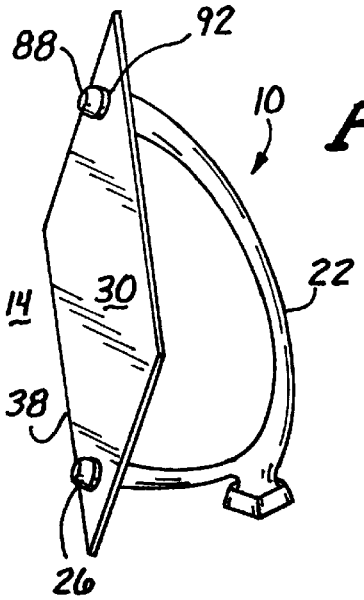
FIG. 7 is a perspective view of a third embodiment of the invention attached to a display item.
Figure 8:
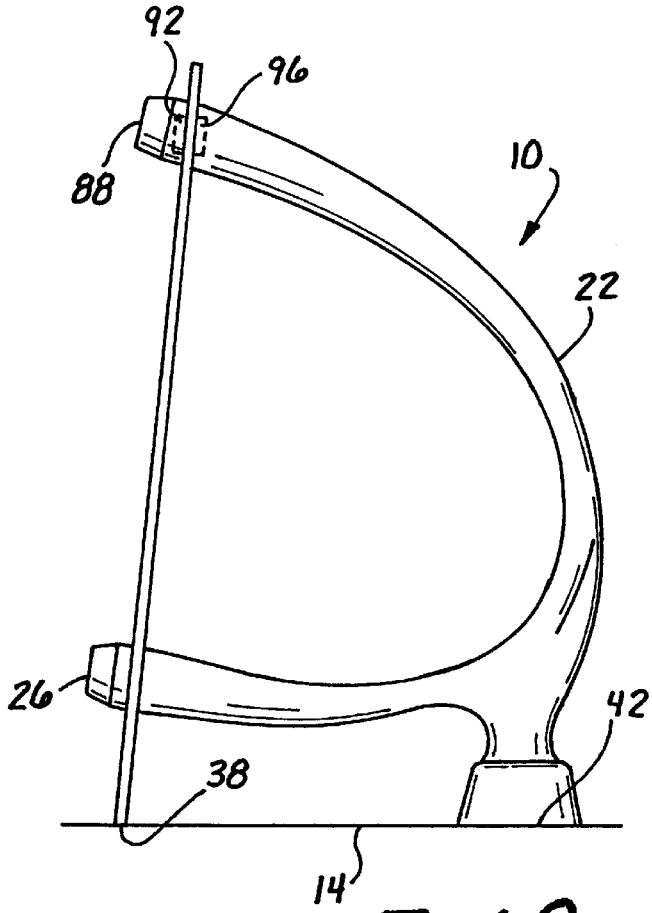
FIG. 8 is a side elevational view of the FIG. 7 embodiment.

In a further variation of the invention, illustrated in FIGS. 7 and 8, a second front surface contacting member 88 including a high-strength magnet 92 is provided that attracts ferromagnetic material 96 in the first support element 22 at the rear surface contacting portion 46.

Figure 10:
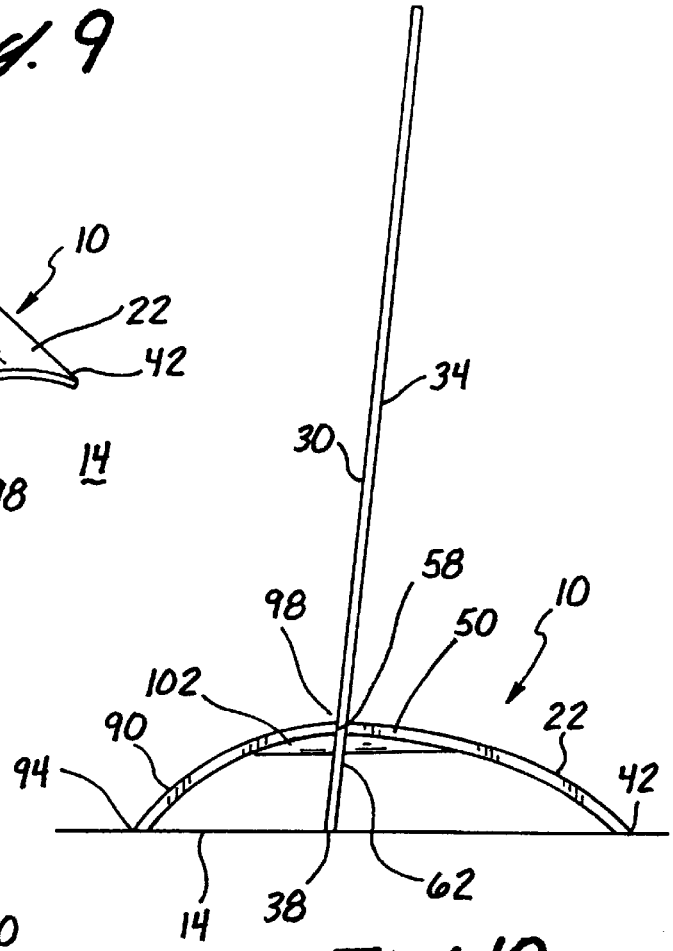
FIG. 10 is a side elevational view of the FIG. 9 embodiment.
Figure 11:
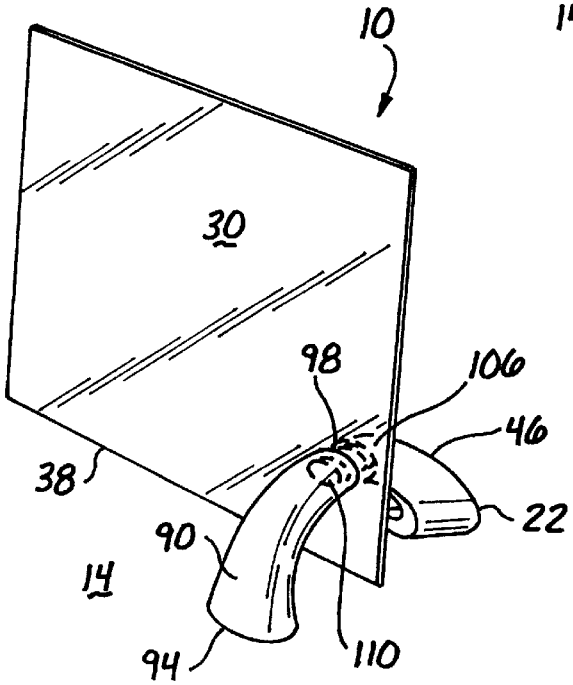
FIG. 11 is a perspective view of a fifth embodiment of the invention attached to a display item.

In yet a further variation of the invention, illustrated in FIGS. 10 and 11, a second support element 90 is provided. The second support element has at least one ground surface contacting portion 94 and at least one front surface contacting portion 98. The front surface contacting portion 98 includes a high-strength magnet 102.

To use this variation of the invention the ground surface contacting portion 42 of the first support element 22 is located on the ground surface 14 and the rear surface 34 of the planar item to be displayed 18 is located on the rear surface contacting portion 46 of the first support element 22. The ground surface contacting portion 94 of the second support element 90 is located on the ground surface 14 and the front surface contacting portion 98 of the second support element 90 is located on the front surface 30 of the item to be displayed 18 at a point 58 closest to the rear surface contacting portion 46 of the first support element 22.

Thus arranged, the high-strength magnet 102 in the second support element 90 will attract the ferromagnetic material 50 in the first support element 22 and cause a magnetic field 62 to flow through the item to be displayed 18. Thus a picture display device 10 may be formed capable of supporting the item to be displayed 18 on the horizontal ground surface 14. The display device 10 balances the item to be displayed 18 between its edge 38, the ground surface contacting portions 42, 94 of the first support element 22 and the second support element 90.

Figure 12:
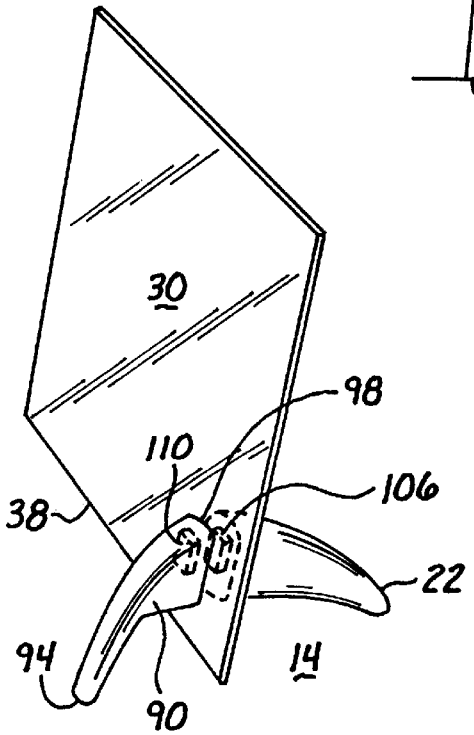
FIG. 12 is a perspective view of a sixth embodiment of the invention attached to a display item.
Figure 9:
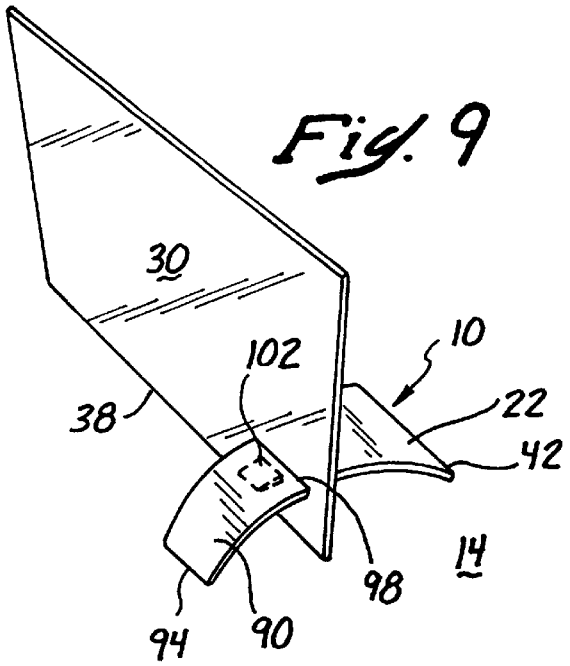
FIG. 9 is a perspective view of a fourth embodiment of the invention attached to a display item.

In a final variation of the invention, illustrated in FIGS. 11 and 12, the rear surface contacting portion 46 of the first support member 22 includes a high-strength magnet 106 and the front surface contacting portion 98 of the second support element 90 includes ferromagnetic material 110.

The magnetic picture display device 10 has been described with reference to particular embodiments. Other modifications and enhancements can be made without departing from the spirit and scope of the claims that follow.

I claim:

1. A magnetic picture display device, comprising:

a horizontal surface;

a planar item to be displayed, said display item having a front surface, a rear surface and at least one edge;

a first support element, said support element having at least one horizontal surface contacting portion and at least one rear surface contacting portion;

said rear surface contacting portion including ferromagnetic material;

at least one front surface contacting member, said front surface contacting member including a high-strength magnet; and said horizontal surface contacting portion of the first support element being disposed upon the horizontal surface, the rear surface of the planar item to be displayed disposed upon the rear surface contacting portion of the first support element and the front surface contacting member disposed upon the front surface of the item to be displayed at a point closest to the rear surface contacting portion of the first support element, thereby attracting the ferromagnetic material in the first support element and causing a magnetic field to flow through the item to be displayed, and forming a picture display device capable of supporting the item to be displayed on the horizontal surface, said display device balancing the item to be displayed between its edge and the horizontal surface contacting portion of the first support element.

2. A magnetic picture display device, comprising:

a horizontal surface;

a planar item to be displayed, said display item having a front surface, a rear surface and at least one edge;

a first support element, said support element having at least one horizontal surface contacting portion and at least one rear surface contacting portion;

said rear surface contacting portion including a high-strength magnet;

at least one front surface contacting member, said front surface contacting member including ferromagnetic material; and said horizontal surface contacting portion of the first support element disposed upon the horizontal surface, the rear surface of the planar item to be displayed disposed upon the rear surface contacting portion of the first support element and the front surface contacting member, disposed upon the front surface of the item to be displayed at a point closest to the rear surface contacting portion of the first support element, thereby being attracted to the high-strength magnet in the first support element and causing a magnetic field to flow through the item to be displayed, and forming a picture display device capable of supporting the item to be displayed on the horizontal surface, said display device balancing the item to be displayed between its edge and the horizontal surface contacting portion of the first support element.

3. A magnetic picture display device as described in claim 1, further comprising:

an edge-engaging member, said edge-engaging member having a first end and a second end;

said first end being fixedly attached to the first support element;

said second end including a notch;

said notch sized, shaped and disposed to engage and constrain an edge of the item to be displayed; and whereby, when the first support element and front surface contacting member are removably attached to the item to be displayed, the edge-engaging member will provide additional support and rigidity to the mounting of the item to be displayed.

4. A magnetic picture display device comprising;

a horizontal surface;

a planar item to be displayed, said display item having a front surface, a rear surface and at least one edge;

a first support element, said support element having at least one horizontal surface contacting portion and at least one rear surface contacting portion;

said rear surface contacting portion including ferromagnetic material;

a second support element, said second support element having at least one horizontal surface contacting portion and at least one front surface contacting portion;

said front surface contacting portion including a high-strength magnet; and said horizontal surface contacting portion of the first support element, being disposed upon the horizontal surface, the rear surface of the planar item to be displayed, disposed upon the rear surface contacting portion of the first support element, the horizontal surface contacting portion of the second support element, disposed upon the horizontal surface and the front surface contacting portion of the second support element, disposed upon the front surface of the item to be displayed at a point closest to the rear surface contacting portion of the first support element, thereby attracting the ferromagnetic material in the first support element and causing a magnetic field to flow through the item to be displayed, and forming a picture display device capable of supporting the item to be displayed on the horizontal surface, said display device balancing the item to be displayed between its edge, the horizontal surface contacting portions of the first support element and the second support element.

5. A magnetic picture display device comprising:

a horizontal surface;

a planar item to be displayed, said display item having a front surface, a rear surface and at least one edge;

a first support element, said support element having at least one horizontal surface contacting portion and at least one rear surface contacting portion;

said rear surface contacting portion including a high-strength magnet;

a second support element, said second support element having at least one horizontal surface contacting portion and at least one front surface contacting portion;

said front surface contacting portion including ferromagnetic material; and said horizontal surface contacting portion of the first support element, being disposed upon the horizontal surface, the rear surface of the planar item to be displayed, disposed upon the rear surface contacting portion of the first support element, the horizontal surface contacting portion of the second support element, disposed upon the horizontal surface and the front surface contacting portion of the second support element, disposed upon the front surface of the item to be displayed at a point closest to the rear surface contacting portion of the first support element, thereby being attracted to the high-strength magnet in the first support element and causing a magnetic field to flow through the item to be displayed, and forming a picture display device capable of supporting the item to be displayed on the horizontal surface, said display device balancing the item to be displayed between its edge, the horizontal surface contacting portions of the first support element and the second support element.

* * * * *